US012349799B2

(12) United States Patent
Pearce

(10) Patent No.: US 12,349,799 B2
(45) Date of Patent: Jul. 8, 2025

(54) CUSHIONS WITH REINFORCED CORNERS

(71) Applicant: Purple Innovation, LLC, Lehi, UT (US)

(72) Inventor: Tony M. Pearce, Alpine, UT (US)

(73) Assignee: Purple Innovation, LLC, Lehi, UT (US)

( * ) Notice: Subject to any disclaimer, the term of this patent is extended or adjusted under 35 U.S.C. 154(b) by 0 days.

(21) Appl. No.: 17/584,183

(22) Filed: Jan. 25, 2022

(65) Prior Publication Data

US 2022/0142373 A1 May 12, 2022

Related U.S. Application Data

(63) Continuation of application No. 15/817,039, filed on Nov. 17, 2017, now Pat. No. 11,229,298.

(51) Int. Cl.

| | |
|---|---|
| ***A47C 27/00*** | (2006.01) |
| ***A47C 27/06*** | (2006.01) |
| ***A47C 27/14*** | (2006.01) |
| ***A47C 27/15*** | (2006.01) |
| ***A47C 27/16*** | (2006.01) |

(52) U.S. Cl.

CPC ..... *A47C 27/00* (2013.01); *A47C 27/065* (2013.01); *A47C 27/144* (2013.01); *A47C 27/15* (2013.01); *A47C 27/16* (2013.01)

(58) Field of Classification Search

None

See application file for complete search history.

(56) References Cited

U.S. PATENT DOCUMENTS

| | | | | |
|---|---|---|---|---|
| 3,526,912 | A | 9/1970 | Lerman | |
| 4,086,675 | A | 5/1978 | Talbert et al. | |
| 4,369,284 | A | 1/1983 | Chen | |
| 5,994,450 | A | 11/1999 | Pearce | |
| 7,730,566 | B2 | 6/2010 | Flick et al. | |
| 7,964,664 | B2 | 6/2011 | Pearce et al. | |
| 8,046,973 | B2 | 11/2011 | Petrolati | |
| 8,434,748 | B1 | 5/2013 | Pearce et al. | |
| 8,628,067 | B2 | 1/2014 | Pearce et al. | |
| 8,919,750 | B2 | 12/2014 | Pearce et al. | |
| 8,932,692 | B2 | 1/2015 | Pearce | |
| 9,796,522 | B2 | 10/2017 | Pearce | |
| 11,229,298 | B2 * | 1/2022 | Pearce | A47C 27/00 |
| 2003/0074863 | A1 | 4/2003 | Mossbeck | |

(Continued)

FOREIGN PATENT DOCUMENTS

| | | | |
|---|---|---|---|
| CN | 200945010 | Y | 9/2007 |
| CN | 202104587 | U | 1/2012 |

(Continued)

OTHER PUBLICATIONS

China National Intellectual Property Administration, "First Office Action," Chinese Application No. 201810825260.0, Dec. 21, 2020.

(Continued)

*Primary Examiner* — Adam C Ortiz

(74) *Attorney, Agent, or Firm* — Foley & Lardner LLP

(57) ABSTRACT

A cushion may include a cushioning element. The cushioning element may comprise an elastomeric material and one or more reinforcing features positioned at one or more exterior portions of the cushioning element.

20 Claims, 5 Drawing Sheets

(56) References Cited

U.S. PATENT DOCUMENTS

| | | | | |
|---|---|---|---|---|
| 2003/0110567 | A1 | 6/2003 | Kawamura et al. | |
| 2010/0227091 | A1* | 9/2010 | Pearce | B32B 3/08 428/36.1 |
| 2011/0010865 | A1* | 1/2011 | Flick | A47C 7/021 5/655.5 |
| 2011/0072587 | A1* | 3/2011 | Cao | A47C 17/70 5/655.9 |
| 2012/0233784 | A1* | 9/2012 | Wood | A47C 27/085 5/690 |
| 2013/0043628 | A1 | 2/2013 | Pearce et al. | |
| 2013/0139321 | A1* | 6/2013 | McCausland | A47C 7/021 5/652.2 |
| 2013/0198965 | A1* | 8/2013 | Melcher | A47C 20/023 5/731 |
| 2015/0203221 | A1 | 7/2015 | Van De Hey et al. | |
| 2017/0251824 | A1 | 9/2017 | Pearce | |
| 2017/0251825 | A1 | 9/2017 | Pearce | |
| 2019/0021514 | A1 | 1/2019 | Hamilton et al. | |
| 2019/0029438 | A1 | 1/2019 | Moon et al. | |

FOREIGN PATENT DOCUMENTS

| | | | |
|---|---|---|---|
| CN | 104433501 | A | 3/2015 |
| WO | 8102384 | A1 | 9/1981 |

OTHER PUBLICATIONS

China National Intellectual Property Administration, "Second Office Action," Chinese Application No. 201810825260.0, May 27, 2021.
China National Intellectual Property Administration, "Third Office Action," Chinese Application No. 201810825260.0, Dec. 3, 2021.
China National Intellectual Property Administration, "Decision on Rejection," Chinese Application No. 201810825260.0, Mar. 18, 2022.

* cited by examiner

CUSHIONS WITH REINFORCED CORNERS

CROSS-REFERENCE

This application is a continuation of U.S. patent application Ser. No. 15/817,039, filed Nov. 17, 2017 and titled CUSHIONS INCLUDING ONE OR MORE REINFORCED PORTIONS AND RELATED METHODS ("the '039 Application"), now U.S. Pat. No. 11,229,298, issued Jan. 25, 2022. The entire disclosure of the '039 Application is hereby incorporated herein.

TECHNICAL FIELD

Embodiments of the disclosure relate generally to elastomeric cushioning elements for compressible cushions, including mattresses, mattress toppers, seat cushions, etc., including reinforcing elements, and to methods of forming cushions including reinforcing elements.

BACKGROUND

Cushioning materials have a variety of uses, such as for mattresses, seating surfaces, shoe inserts, packaging, medical devices, etc. Cushioning materials may be formulated and/or configured to reduce peak pressure on a cushioned body, which may increase comfort for humans or animals, and may protect objects from damage. Cushioning materials may be formed of materials that deflect or deform under load, such as polyethylene or polyurethane foams (e.g., convoluted foam), vinyl, rubber, springs, natural or synthetic fibers, fluid filled flexible containers, etc. Different cushioning materials may have different responses to a given pressure, and some materials may be well suited to different applications. Cushioning materials may be used in combination with one another to achieve selected properties.

U.S. Pat. No. 7,730,566, "Multi Walled Gelastic Material," issued Jun. 8, 2010, the disclosure of which is incorporated herein in its entirety by this reference, describes cushion structures having interconnected walls that buckle. A first wall buckles when a threshold force is applied. Buckling of the first wall may cause buckling of a second wall, which may decrease the chance that the first wall will "bottom out." Bottoming out would increase pressure on the portion of the cushioned object over the buckled portion of the cushion. One side of the cushion has walls spaced relatively close together, and the opposite side has walls spaced farther apart. That is, some walls of the cushion extend only partially through the cushion. The wider spaced portions of the walls may buckle more easily than the closer spaced portions of the walls when an irregularly shaped object presses against the walls.

U.S. Pat. No. 8,919,750, "Cushioning Elements Comprising Buckling Walls and Methods of Forming Such Cushioning Elements," issued Dec. 30, 2014, the disclosure of which is incorporated herein in its entirety by this reference, describes a cushioning element having a top cushioning surface and a bottom base surface, and which includes an elastomeric material and a stabilizing material. Interconnected buckling walls formed of the elastomeric material are connected to the stabilizing material.

BRIEF SUMMARY

In some embodiments, a cushion includes a cushioning element. The cushioning element may comprise an elastomeric material forming a plurality of intersecting buckling walls defining a plurality of voids in an expanded form. The elastomeric material may comprise an elastomeric polymer and a plasticizer. The cushioning element may also comprise a reinforced corner including a stiffening feature. The stiffening feature may comprise a characteristic of at least one of the intersecting buckling walls in the reinforced corner or an element disposed in at least one void in the reinforced corner.

In some embodiments, a compressed cushion includes a cushioning element comprising an elastomeric material and at least one corner that comprises a reinforced portion. The elastomeric material may comprise an elastomeric polymer and a plasticizer. The reinforced portion exhibiting at least one of a higher stiffness or a higher elasticity relative to central portions of the cushioning element Methods of forming a cushion are also disclosed. The method includes forming a cushioning element comprising an elastomeric material. The cushioning element comprises a plurality of intersecting buckling walls defining a plurality of hollow columns in an expanded form. The method includes reinforcing at least one corner of the cushioning element such that the at least one corner exhibits relatively higher stiffness relative to central portions of the cushioning element.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
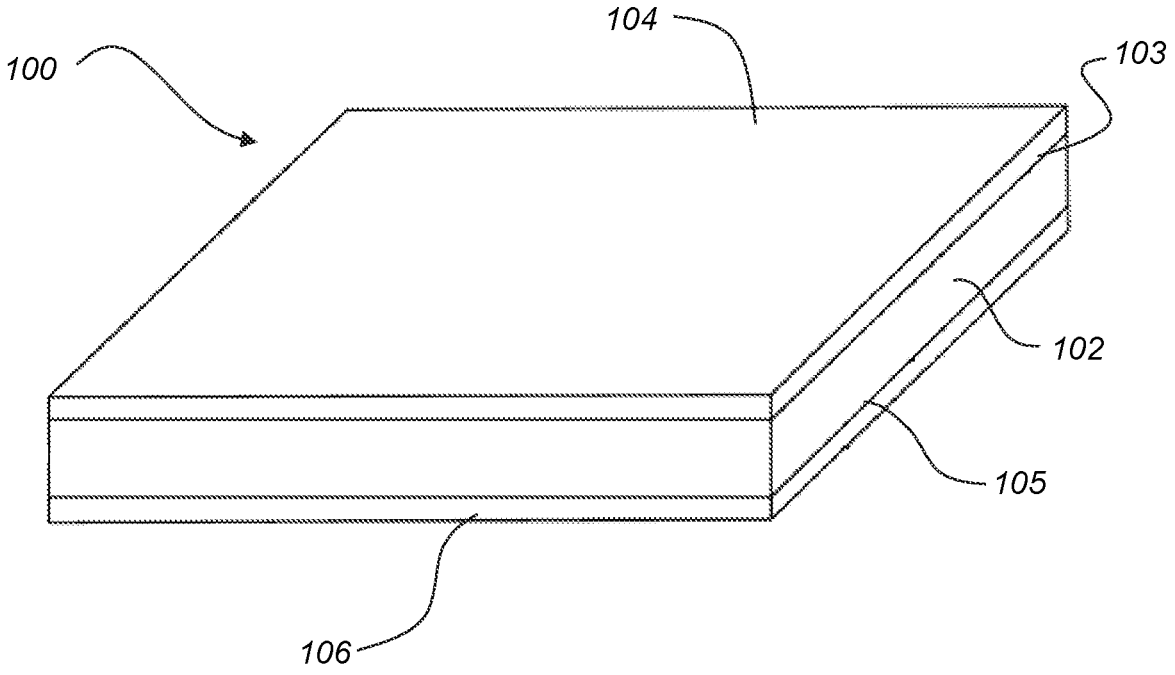
FIG. 1 is a perspective view of a cushion in an expanded form according to an embodiment of the present disclosure.

The illustrations presented herein are not meant to be actual views of any particular cushion, cushioning element, reinforcing element, or component thereof, but are merely idealized representations employed to describe illustrative embodiments. The drawings are not necessarily to scale. Elements common between figures may retain the same numerical designation.

As used herein, the term "cushioning element" means and includes any deformable device intended for use in cushioning one body relative to another. As a non limiting example, cushioning elements (e.g., mattresses, seat cushions, etc.) include materials intended for use in cushioning a person, animal, or object relative to another object (e.g., a bed frame, chair seat, etc.) that might otherwise abut against the person, animal, or object.

As used herein, the term "elastomeric polymer" means and includes a polymer capable of recovering its original size and shape after deformation. In other words, an elastomeric polymer is a polymer having elastic or viscoelastic properties. Elastomeric polymers may also be referred to as "elastomers" in the art. Elastomeric polymers include, without limitation, homopolymers (polymers having a single chemical unit repeated) and copolymers (polymers having two or more chemical units).

As used herein, the term "elastomeric block copolymer" means and includes an elastomeric polymer having groups or blocks of homopolymers linked together, such as A-B diblock copolymers and A-B-A triblock copolymers. A-B diblock copolymers have two distinct blocks of homopolymers. A-B-A triblock copolymers have two blocks of a single homopolymer (A) each linked to a single block of a different homopolymer (B).

As used herein, the term "plasticizer" means and includes a substance added to another material (e.g., an elastomeric polymer) to increase a workability of the material. For example, a plasticizer may increase the flexibility, softness, or extensibility of the material. Plasticizers include, without limitation, hydrocarbon fluids, such as mineral oils. Hydrocarbon plasticizers may be aromatic or aliphatic.

As used herein, the term "elastomeric material" means and includes elastomeric polymers and mixtures of elastomeric polymers with plasticizers and/or other materials. Elastomeric materials are elastic (i.e., capable of recovering size and shape after deformation). Elastomeric materials include, without limitation, materials referred to in the art as "elastomer gels," "gelatinous elastomers," or simply "gels."

As used herein, any relational term, such as "first," "second," "top," "bottom," etc., is used for clarity and convenience in understanding the disclosure and accompanying drawings and does not connote or depend on any specific preference, orientation, or order, except where the context clearly indicates otherwise.

As used herein, the term "and/or" means and includes any and all combinations of one or more of the associated listed items.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Applicant has found that cushioning elements may deform when pressure is applied laterally upon the cushioning element. A lateral force may be applied by an elastic cover (e.g., mattress cover, fitted sheet, mattress protector, seat cover, etc.) causing the cushioning element to deform. Deformation due to an elastic cover may cause the cushioning element to assume an undesirable shape. The undesirable shape may cause fitment problems with a support base (e.g., box spring, bed frame, seat, etc.) in or on which the cushioning element may be placed and/or secured.

The present disclosure describes a cushion that may be roll packed, folded, or otherwise compressed for display, storage, and/or shipping to a customer. For example, the cushion may be roll packed into a cylindrical shape. The roll-packed cushion may be provided in a cylindrical bag. Cylindrical bags for shipping roll-packed cushions are described in, for example, U.S. patent application Ser. No. 15/063,114, "A Bag for Shipping a Cushion and Related Methods," filed Mar. 7, 2016, assigned to the assignee of the present application, the entire disclosure of which is hereby incorporated herein by this reference. Cushions compressed and disposed in cylindrical bags may be easier to handle than cushions, such as mattresses that are traditionally packaged, shipped, and sold in a flat configuration.

FIG. 1 illustrates a perspective view of a cushion 100 according to some embodiments of the present disclosure. The cushion 100 may comprise an elastomeric cushioning element 102 between a top layer 104 and a bottom layer 106. The top layer 104 may be provided on (e.g., attached to) a top surface 103 of the elastomeric cushioning element 102. The bottom layer 106 may be provided on a bottom surface 105 of the elastomeric cushioning element 102.

In some embodiments, the top layer 104 and the bottom layer 106 may comprise a foam material. In other embodiments, the top layer 104 may comprise a stretchable material secured to or integral with the elastomeric cushioning element 102. Such a stretchable material is described in U.S. patent application Ser. No. 15/062,621, "Mattresses and Mattress Toppers Including Knitted Fabric, and Related Methods," filed Mar. 7, 2016, assigned to the assignee of the present application, the entire disclosure of which is incorporated herein by this reference. In yet other embodiments, the cushion 100 may comprise additional layers.

Figure 2:
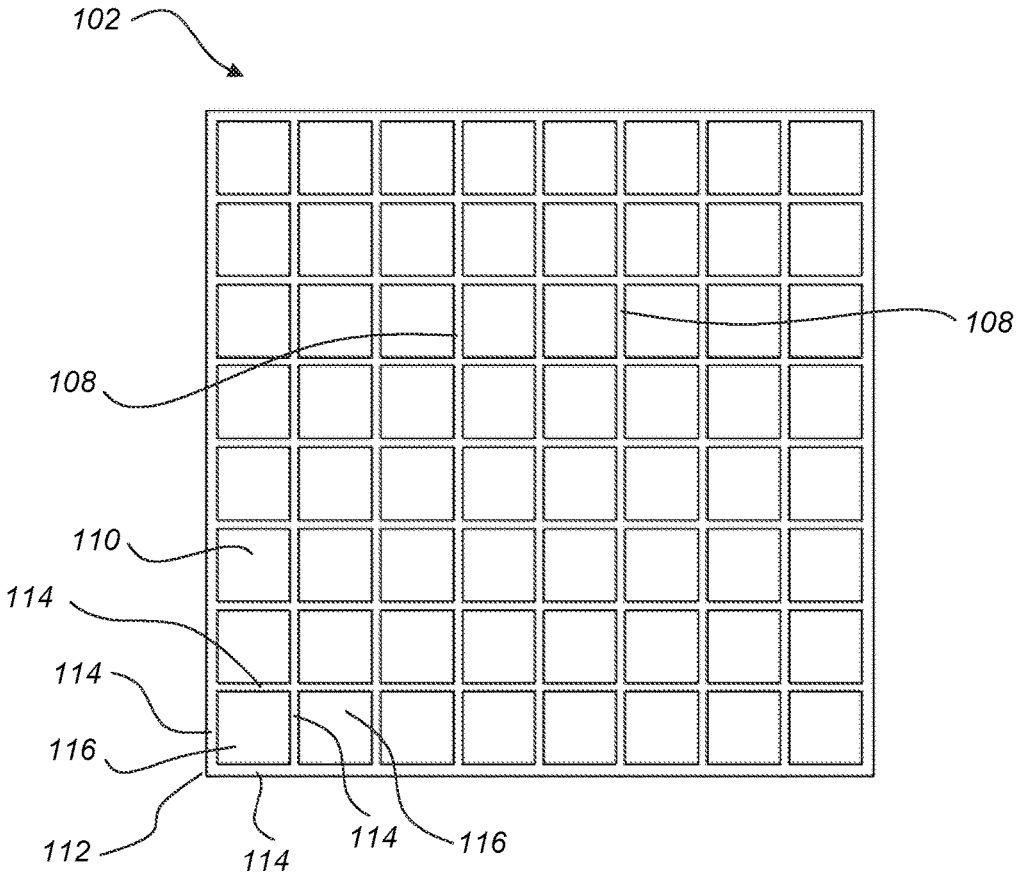
FIG. 2 is a top view of an elastomeric cushioning element of the cushion of FIG. 1 according to an embodiment of the present disclosure.

FIG. 2 illustrates a simplified top view of the elastomeric cushioning element 102 having buckling walls 108 (e.g., cell walls, collapsible walls). The buckling walls 108 of the elastomeric cushioning element 102 may be interconnected to one another and may define hollow columns 110 (e.g., voids, cells) in an expanded form. As used herein, the term "expanded form" means and includes a state in which an elastomeric cushioning element 102 has its original size and shape and wherein the buckling walls 108 are separated and define hollow columns 110 (e.g., in a substantially uncompressed state).

FIG. 2 illustrates buckling walls 108 oriented in two directions, intersecting at right angles, and defining rectangular (e.g., square) voids 110. However, the buckling walls 108 may intersect at other angles and define voids 110 of other shapes, such as triangles, parallelograms, hexagons, other quadrilaterals, polygons, etc. The elastomeric cushioning element 102 may comprise additional structures and configurations such as those structures and configurations described in, for example, U.S. Pat. No. 8,434,748, "Cushions Comprising Gel Springs," issued May 7, 2013; U.S. Pat. No. 8,628,067, "Cushions Comprising Core Structures and Related Methods," issued Jan. 14, 2014; U.S. Pat. No. 8,919,750, "Cushioning Elements Comprising Buckling Walls and Methods of Forming Such Cushioning Elements," issued Dec. 30, 2014; and U.S. Pat. 8,932,692, "Cushions Comprising Deformable Members and Related Methods," issued Jan. 13, 2015, the entire disclosures of each of which are incorporated herein by this reference.

The buckling walls 108 may be formed of an elastomeric material. Elastomeric materials are described in, for example, U.S. Pat. No. 5,994,450, "Gelatinous Elastomer and Methods of Making and Using the Same and Articles Made Therefrom," issued Nov. 30, 1999; U.S. Pat. No. 7,964,664, "Gel with Wide Distribution of MW in Mid Block" issued Jun. 21, 2011; U.S. Pat. No. 4,369,284, "Thermoplastic Elastomer Gelatinous Compositions" issued Jan. 18, 1983; U.S. Pat. No. 8,919,750, "Cushioning Elements Comprising Buckling Walls and Methods of Forming Such Cushioning Elements," issued Dec. 30, 2014; the entire disclosures of each of which are incorporated herein by this reference. The elastomeric material may include an elastomeric polymer and a plasticizer. The elastomeric material may be a gelatinous elastomer (also referred to in the art as gel, elastomer gel, or elastomeric gel), a thermoplastic elastomer, a natural rubber, a synthetic elastomer, a blend of natural and synthetic elastomers, etc.

The elastomeric polymer may be an A-B-A triblock copolymer such as styrene ethylene propylene styrene (SEPS), styrene ethylene butylene styrene (SEBS), and styrene ethylene ethylene propylene styrene (SEEPS). For example, A-B-A triblock copolymers are currently commercially available from Kuraray America, Inc., of Houston, TX, under the trade name SEPTON® 4055, and from Kraton Polymers, LLC, of Houston, TX, under the trade names KRATON® E1830, KRATON® G1650, and KRATON® G1651. In these examples, the "A" blocks are styrene. The "B" block may be rubber (e.g., butadiene, isoprene, etc.) or hydrogenated rubber (e.g., ethylene/propylene or ethylene/butylene or ethylene/ethylene/propylene) capable of being plasticized with mineral oil or other hydrocarbon fluids. The elastomeric material may include elastomeric polymers other than styrene based copolymers, such as non styrenic elastomeric polymers that are thermoplastic in nature or that can be solvated by plasticizers or that are multi component thermoset elastomers.

The elastomeric material may include one or more plasticizers, such as hydrocarbon fluids. For example, elastomeric materials may include aromatic free food grade white paraffinic mineral oils, such as those sold by Sonneborn, Inc., of Mahwah, NJ, under the trade names BLANDOL® and CARNATION®.

In some embodiments, the elastomeric material may have a plasticizer to polymer ratio from about 0.1:1 to about 50:1 by weight. For example, elastomeric materials may have plasticizer to polymer ratios from about 1:1 to about 30:1 by weight, or even from about 1.5:1 to about 10:1 by weight. In further embodiments, elastomeric materials may have plasticizer to polymer ratios of about 4:1 by weight.

The elastomeric material may have one or more fillers (e.g., lightweight microspheres). Fillers may affect thermal properties, density, processing, etc., of the elastomeric material. For example, hollow microspheres (e.g., hollow glass microspheres or hollow acrylic microspheres) may decrease the thermal conductivity of the elastomeric material by acting as an insulator because such hollow microspheres (e.g., hollow glass microspheres or hollow acrylic microspheres) may have lower thermal conductivity than the plasticizer or the polymer. As another example, metal particles (e.g., aluminum, copper, etc.) may increase the thermal conductivity of the resulting elastomeric material because such particles may have greater thermal conductivity than the plasticizer or polymer. Microspheres filled with wax or another phase change material (i.e., a material formulated to undergo a phase change near a temperature at which a cushioning element may be used) may provide temperature stability at or near the phase change temperature of the wax or other phase change material within the microspheres (i.e., due to the heat of fusion of the phase change). The phase change material may have a melting point from about 20° C. to about 45° C.

The elastomeric material may also include antioxidants. Antioxidants may reduce the effects of thermal degradation during processing or may improve long term stability. Antioxidants include, for example, pentaerythritol tetrakis(3 (3,5 di tert butyl 4 hydroxyphenyl) propionate), commercially available as IRGANOX® 1010, from BASF Corp., of Iselin, NJ or as EVERNOX® 10, from Everspring Corp. USA, of Los Angeles, CA; octadecyl 3 (3,5 di tert butyl 4 hydroxyphenyl)propionate, commercially available as IRGANOX® 1076, from BASF Corp. or as EVERNOX® 76, from Everspring Chemical; and tris(2,4 di tert butylphenyl)phosphite, commercially available as IRGAFOS® 168, from BASF Corp. or as EVERFOS® 168, from Everspring Chemical. One or more antioxidants may be combined in a single formulation of elastomeric material. The use of antioxidants in mixtures of plasticizers and polymers is described in columns 25 and 26 of U.S. Pat. No. 5,994,450, previously incorporated by reference. The elastomeric material may include up to about 5 wt % antioxidants. For instance, the elastomeric material may include from about 0.10 wt % to about 1.0 wt % antioxidants.

In some embodiments, the elastomeric material may include a resin. The resin may be selected to modify the elastomeric material to slow a rebound of the elastomeric cushioning element 102 after deformation. The resin, if present, may include a hydrogenated pure monomer hydrocarbon resin, such as those commercially available from Eastman Chemical Company, of Kingsport, TN, under the trade name REGALREZ®. The resin, if present, may function as a tackifier, increasing the stickiness of a surface of the elastomeric material.

In some embodiments, the elastomeric material may include a pigment or a combination of pigments. Pigments may be aesthetic and/or functional. That is, pigments may provide the elastomeric cushioning element 102 with an appearance appealing to consumers. In addition, an elastomeric cushioning element 102 having a dark color may absorb radiation differently than an elastomeric cushioning element 102 having a light color.

The elastomeric material may include any type of gelatinous elastomer. For example, the elastomeric material may include a melt blend of one part by weight of a styrene ethylene ethylene propylene styrene (SEEPS) elastomeric triblock copolymer (e.g., SEPTON® 4055) with four parts by weight of a 70 weight straight cut white paraffinic mineral oil (e.g., CARNATION® white mineral oil) and, optionally, pigments, antioxidants, and/or other additives.

The elastomeric material may include a material that may return to its original shape after deformation, and that may be elastically stretched. The elastomeric material may be rubbery in feel, but may deform to the shape of an object applying a deforming pressure better than conventional rubber materials, and may have a durometer hardness lower than conventional rubber materials. For example, the elastomeric material may have a hardness on the Shore A scale of less than about 50, from about 0.1 to about 50, or less than about 5.

In some embodiments, the elastomeric cushioning element 102 may be compressed. For example, the elastomeric cushioning element 102 may be roll packed into a cylindrical shape. Methods of roll-packing a mattress are described in, for example, U.S. Pat. No. 8,046,973, "Machine for Packaging Mattresses," issued Nov. 1, 2011; U.S. Patent Publication No. 2003/0074863, "Method for Roll Packing Foam Cores," published Apr. 24, 2003; U.S. Patent Publication No. 2015/0203221, "System and Method for Packaging a Foam Product," published Jul. 23, 2015; and U.S. patent application Ser. No. 15/063,114, "A Bag for Shipping a Cushion and Related Methods," filed Mar. 7, 2016, assigned to the assignee of the present application; the entire disclosures of each of which are incorporated herein by this reference.

In some embodiments, the roll-packing machine may apply a load sufficient to transform the elastomeric cushioning element 102 to a compressed form. As used herein, the term "compressed form" means and includes a state in which the elastomeric cushioning element 102 has a size and shape different from its original size and shape, wherein adjacent buckling walls 108 are substantially pressed together and may be collapsed such that voids 110 may be minimized or may not substantially exist. As described in U.S. patent application Ser. No. 15/063,114, previously incorporated herein, the cushion 100 including the elastomeric cushioning element 102 in compressed form may be packaged, such as in a cylindrical bag, and shipped to a customer. To use the cushion 100, the customer may remove the cushion 100 from the packaging and allow the cushion 100 and the elastomeric cushioning element 102 to return to its original size and shape.

It has been observed that the elastomeric material, according to embodiments of the present disclosure, may be sufficiently sticky such that the elastomeric cushioning element 102 may not return to the expanded form after the cushion 100 is removed from the bag. That is, the buckling walls 108 may stick to one another or remain stuck to one another after the cushion 100 is removed from the bag. In some embodiments, the elastomeric cushioning element 102 may not return to the expanded form within a reasonable amount of time (e.g., less than approximately eight hours). In other embodiments, the elastomeric cushioning element 102 may not return to the expanded form without manually or mechanically manipulating (e.g., pulling on) the elastomeric cushioning element 102 to separate the buckling walls 108. However, when the elastomeric cushioning element 102 is formed as part of the cushion 100, the layers 104 or 106 may inhibit direct access to the elastomeric cushioning element 102 and may hinder manipulation of the elastomeric cushioning element 102 in order to separate the buckling walls 108. This sticking together of polymeric materials is referred to in the art as "blocking." To enable the elastomeric cushioning element 102 to return to the expanded form from the compressed form, a surface of the elastomeric cushioning element 102 may have a coating material (e.g., anti-tack material, anti-stick material) on surfaces of the buckling walls 108. Coating materials may include a thin film covering all portions of the buckling walls 108 as described in U.S. patent application Ser. No. 15/654,948, "Cushions Including a Coated Elastomeric Cushioning Element and Related Methods," filed Jul. 20, 2017, assigned to the assignee of the present application, the entire disclosure of which is hereby incorporated herein by this reference. Coating materials may also include powders as described in U.S. patent application Ser. No. 15/062,674, "Cushions Including a Coated Elastomeric Cushioning Element and Related Methods," filed Mar. 7, 2017, assigned to the assignee of the present application, the entire disclosure of which is hereby incorporated herein by this reference.

In some embodiments, the elastomeric cushioning element 102 may have an elastic cover (e.g., mattress topper, fitted sheet, seat cover, mattress protector, and mattress cover) provided with the cushion 100 or added by an end user. The tension of the elastic cover may cause portions of the buckling walls 108 near the edges of the elastomeric cushioning element 102 to deform and/or collapse into the voids 110 between the buckling walls 108. The deformation of the buckling walls 108 may cause the elastomeric cushioning element 102 to deform. The deformation of the elastomeric cushioning element 102 may create fitment issues with a securing element (e.g., frame, chassis, or base) used to secure the elastomeric cushioning element 102 to a bed, or chair.

In some embodiments, the elastomeric cushioning element 102 may have a shape (e.g., square, rectangle, triangle, pentagon, etc.), which has one or more corners 112. FIG. 2 demonstrates an embodiment of an elastomeric cushioning element 102 with a rectangular shape. In a shape with exterior portions (e.g., corners 112, exterior side portions extending between the corners 112, or combinations thereof), the largest deformation may tend to occur at the exterior portions (e.g., the corners 112). Reinforcing (e.g., stiffening, supporting, bolstering) the corners 112 may limit the deformation of the elastomeric cushioning element 102 at the corners 112. The corners 112 may be reinforced by changing a feature and/or material property (e.g., dimension, material type, orientation, geometry, density, etc.) of the buckling walls 108 or disposing an element into the voids 110 in the corners 112 such that the corners 112 exhibit increased stiffness relative to other portions of the elastomeric cushioning element 102 (e.g., portion outside or exterior to the corners 112, central portion of the elastomeric cushioning element 102).

For example, in the embodiment of FIG. 2, walls 114 surrounding four voids 116 in the corners 112 of the elastomeric cushioning element 102 may be formed from a stiffer material (e.g., higher elastic modulus and lower elasticity) than the walls 108 in the remainder of the elastomeric cushioning element 102. In other embodiments, for example, the walls 114 surrounding the four voids 116 in the corners of the elastomeric cushioning element 102 could have a thickness that is 120% thicker, or more, than the walls 108 in the remainder of the elastomeric cushioning element 102.

Figures 3A, 3B, 3C:
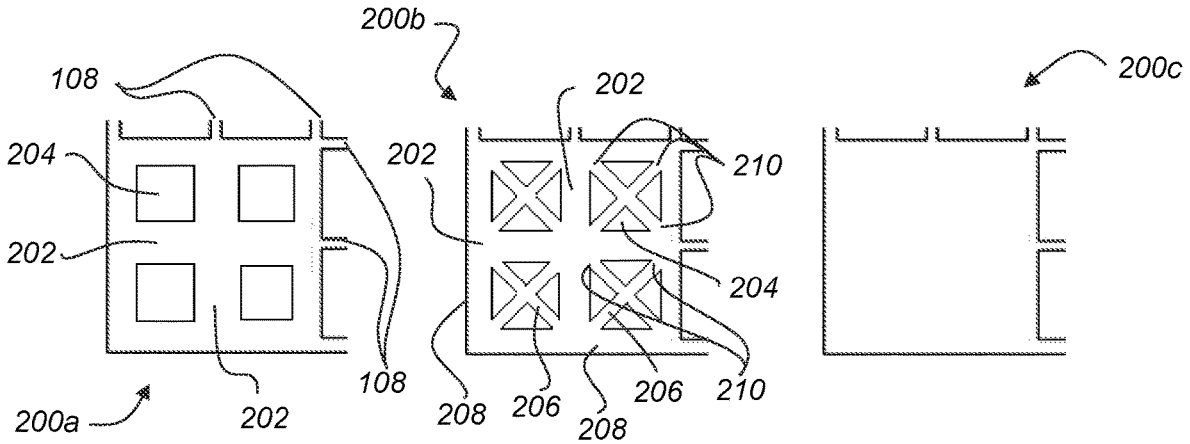
FIG. 3A is a top view of an embodiment of a reinforced corner of a cushioning element.
FIG. 3B is a top view of an embodiment of a reinforced corner of a cushioning element.
FIG. 3C is a top view of an embodiment of a reinforced corner of a cushioning element.

FIG. 3A shows another embodiment of a reinforced corner 200*a*, which may be employed in the cushioning element 102 of FIG. 2. The reinforced corner 200*a* may include reinforced buckling walls 202. A material (e.g., an elastomeric material) may at least partially fill (e.g., 10%, 20%, 40%, 60%, 80%, 100%) voids in reinforced columns 204 in the reinforced corner 200*a* to create reinforced buckling walls 202 having a thickness greater than the buckling walls 108 (FIG. 2) in other areas of the elastomeric cushioning element 102 (e.g., in central and/or interior side portions that extend between the corners 112 (FIG. 2)). The increased thickness of the reinforced buckling walls 202 may alter the response of the reinforced buckling walls 202 to a force (e.g., compressive forces, such as, lateral forces) with respect to the buckling walls 108 (FIG. 2) in other areas of the elastomeric cushioning element 102. In some embodiments, the volume within the reinforced columns 204 may be reduced (e.g., as compared to voids 110 (FIG. 2) in a central portion of the elastomeric cushioning element 102) due the increased wall thickness of the reinforced buckling walls 202. In some embodiments, the volume within the reinforced columns 204 may be reduced due to additional material disposed in the reinforced columns 204 that extend within and between one or more of the reinforced buckling walls 202.

FIG. 3B shows another embodiment of a reinforced corner 200*b*, which may be employed in the elastomeric cushioning element 102 of FIG. 2. The reinforced corner 200*b* may include additional buckling walls 206 positioned in the reinforced columns 204. The additional buckling walls 206 may be oriented parallel, transverse, and/or perpendicular to one or more of the reinforced buckling walls 202. The additional buckling walls 206 may be positioned in a middle portion of the exterior walls 308 (e.g., may bisect the reinforced buckling walls 202), effectively bisecting the volume within reinforced columns 204. In some embodiments, a plurality of additional buckling walls 206 may be formed at equal spacing along the reinforced buckling walls 202. In other embodiments, the spacing between the additional buckling walls 206 may be different. For example, the spacing of the additional buckling walls 206 may be closer nearer to an edge 208 of the reinforced corner 200*b* with the spacing progressively enlarging as the distance from the edge 208 of the reinforced corner 200*b* increases. In some embodiments, a plurality of additional buckling walls 206 may be positioned perpendicular to each other within the reinforced columns 204. In other embodiments, the plurality of additional buckling walls 206 may be positioned parallel to each other within the reinforced columns 204.

In some embodiments, the additional buckling walls 206 may be oriented at an angle from the reinforced buckling walls 202. For example, the additional buckling walls 206 may be oriented such that they extend between corners 210 of the reinforced columns 204 formed by the reinforced buckling walls 202. In some embodiments, the additional buckling walls 206 may extend between each corner 210 of the reinforced columns 204 intersecting in the middle in order to form an "X" shape. In other embodiments, a plurality of additional buckling walls 206 may extend at a common angle relative to the reinforced buckling walls 202 with each additional buckling wall 206 parallel to the other additional buckling walls 206. For example, one of the additional buckling walls 206 may extend between two of the corners 210 of the reinforced column 204, with other additional buckling walls 206 running parallel to the first additional buckling wall 206 offset on each side of the first additional buckling wall 206 within the reinforced column 204.

Some embodiments may combine the numbers and orientations set forth above with different reinforced columns 204 having different numbers and orientations of additional buckling walls 206. The different combinations may exhibit different qualities that may be desirable in different areas of the elastomeric cushioning element 102 (FIG. 2).

In some embodiments, the additional buckling walls 206 may be formed from the same elastomeric material as the other portions of the elastomeric cushioning element 102 (FIG. 2). In other embodiments, the elastomeric material may be a different elastomeric material from the elastomeric material used to form the other portions of the elastomeric cushioning element 102 (FIG. 2). The different elastomeric material may be formulated to have a different elasticity (e.g., stiffness, young's modulus) than the elastomeric material used to form the other portions of the elastomeric cushioning element 102 (FIG. 2). In some embodiments, the different elastomeric material may be formulated to have a higher elasticity than the elastomeric material used to form the other portions of the elastomeric cushioning element 102 (FIG. 2). In other embodiments, the different elastomeric material may have a lower elasticity than the elastomeric material used to form the other portions of the elastomeric cushioning element 102 (FIG. 2).

FIG. 3C shows another embodiment of a reinforced corner 200*c* which may be employed in the elastomeric cushioning element 102 of FIG. 2. The voids 110 (FIG. 2) may be at least partially removed from the reinforced corner 200*c*. For example, the voids 110 (FIG. 2) may be substantially filled with the elastomeric material. Filling the voids 110 (FIG. 2) may remove the reinforced buckling walls 202 (FIGS. 3A and 3B) and the volume within the reinforced columns 204 (FIGS. 3A and 3B) from the reinforced corner 200*c*. In some embodiments, the elastomeric cushioning element 102 (FIG. 2) may be formed without voids 110 (FIG. 2) in the reinforced corners 200*c*. For example, the elastomeric cushioning element 102 (FIG. 2) may entirely lack voids 110 (FIG. 2) in a portion proximate the reinforced corners 200*c*.

Figure 4:
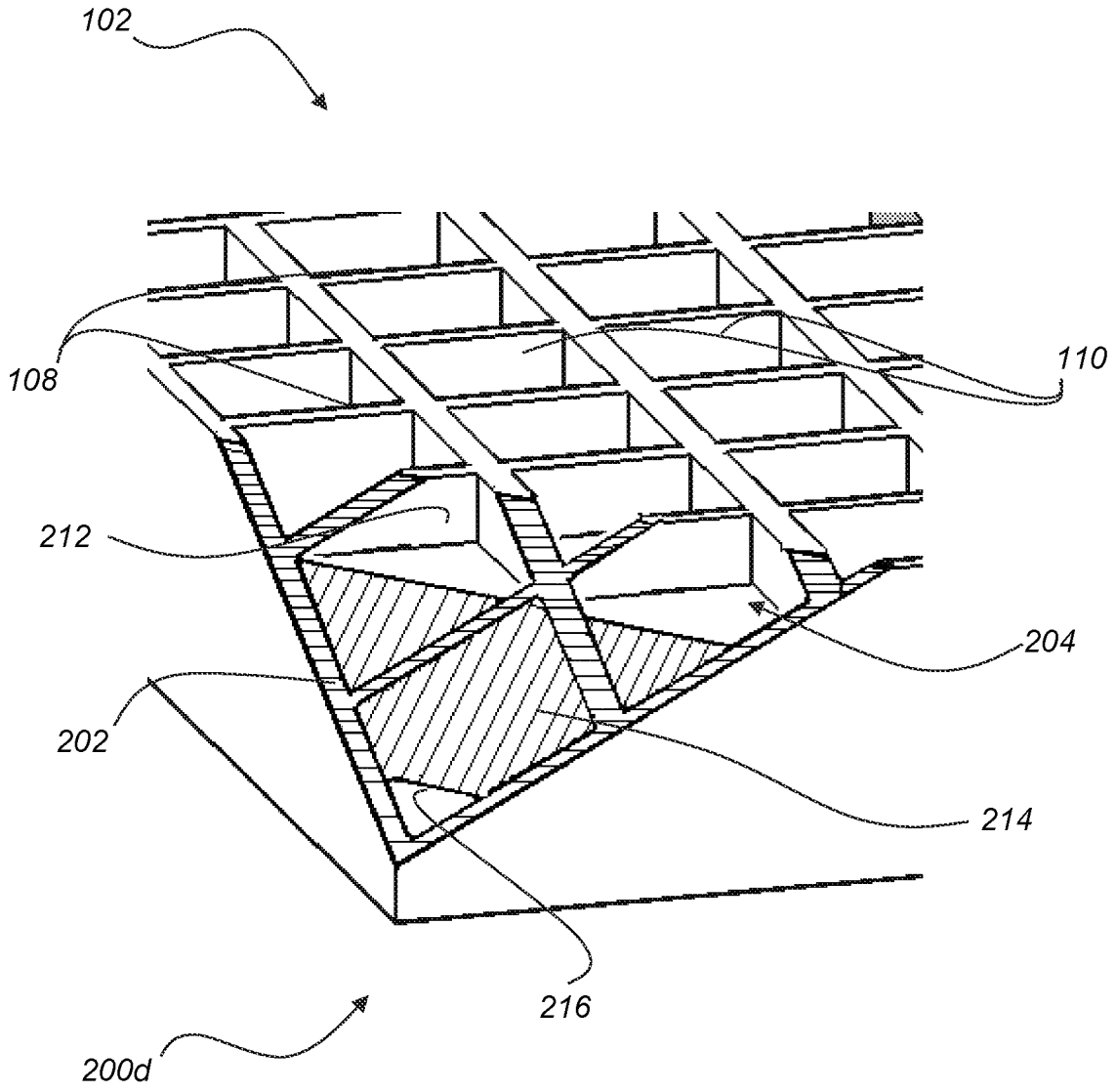
FIG. 4 is a partially cut-away isometric view of a cushion having an embodiment of a reinforcing element at a corner thereof.

FIG. 4 shows an embodiment of the reinforced corner 200*d* which may be employed in the cushioning element of FIG. 2. The reinforced corner 200*d* has reinforced columns 204 partially filled with a material (e.g., an elastomeric material). In some embodiments, the elastomeric material may at least partially fill the volume in the reinforced columns 204 in a substantially planar level parallel to the surface of the elastomeric cushioning element 102. In some embodiments, the elastomeric material may leave a top or upper portion 212 of the volume in the reinforced columns 204 open. A bottom portion 216 of the reinforced columns 204 may also be left open with the elastomeric material partially filling a middle portion 214 of the reinforced column 204. In some embodiments, the elastomeric material may fill the bottom portion 216 of the reinforced column 204 leaving the top portion 212 of the reinforced column 204 open. In other embodiments, the elastomeric material may fill the top portion 212 of the reinforced column 204 leaving the bottom portion 216 of the reinforced column 204 open. In yet another embodiment, the top portion 212 and bottom portion 216 of the reinforced column 204 may be filled with the elastomeric material leaving a middle portion 214 open.

In some embodiments, the reinforced columns 204 may be filled with material other than an elastomer material (e.g., foam).

Referring to the reinforced corners demonstrated in the embodiments of FIGS. 2, 3A through 3C and 4. In some embodiments, the elastomeric material added to the reinforced corners 200*a*-200*d* may be a different elastomeric material from the elastomeric material used to form the other portions of the elastomeric cushioning element 102. The different elastomeric material may be formulated to have a different elasticity (e.g., stiffness, young's modulus) than the elastomeric material used to form the other portions of the elastomeric cushioning element 102. In some embodiments, the different elastomeric material may be formulated to have a higher elasticity than the elastomeric material used to form the other portions of the elastomeric cushioning element 102. In other embodiments, the different elastomeric material may have a lower elasticity than the elastomeric material used to form the other portions of the elastomeric cushioning element 102.

In some embodiments, a material with a different density may be used to form at least one of the features in the reinforced corner 200*a*-200*d*. By way of example but not limitation, a higher density material may be used to form the additional buckling walls 206, or a lower density material may be used to fill in the voids 110 in the reinforced corners 200*c*, 200*d*. In some embodiments, a higher density material may be used to form the reinforced buckling walls 202 in the reinforced corners 200*a*-200*d*.

FIGS. 3A through 3C and 4 each demonstrate reinforced corners 200*a*-200*d* having reinforced buckling walls 202 defining reinforced columns 204 with a rectangular shape. However, some embodiments may define reinforced columns 204 of other shapes, such as triangles, parallelograms, hexagons, etc. The reinforced corners 200*a*-200*d* may utilize any combination of shapes for the reinforced columns 204.

FIGS. 3A through 3C and 4 demonstrate embodiments where elastomeric material is added to four of the hollow columns 110 (FIG. 2) in the reinforced corners 200*a*-200*d* to create four reinforced columns 204. However, other embodiments may include more or less reinforced columns 204. For example, some embodiments may add elastomeric material to one hollow column 110 (FIG. 2) creating a single reinforced column 204, while other embodiments may add elastomeric material to six hollow columns 110 (FIG. 2) or three hollow columns 110 (FIG. 2) creating the respective number of reinforced columns 204.

Figure 5:
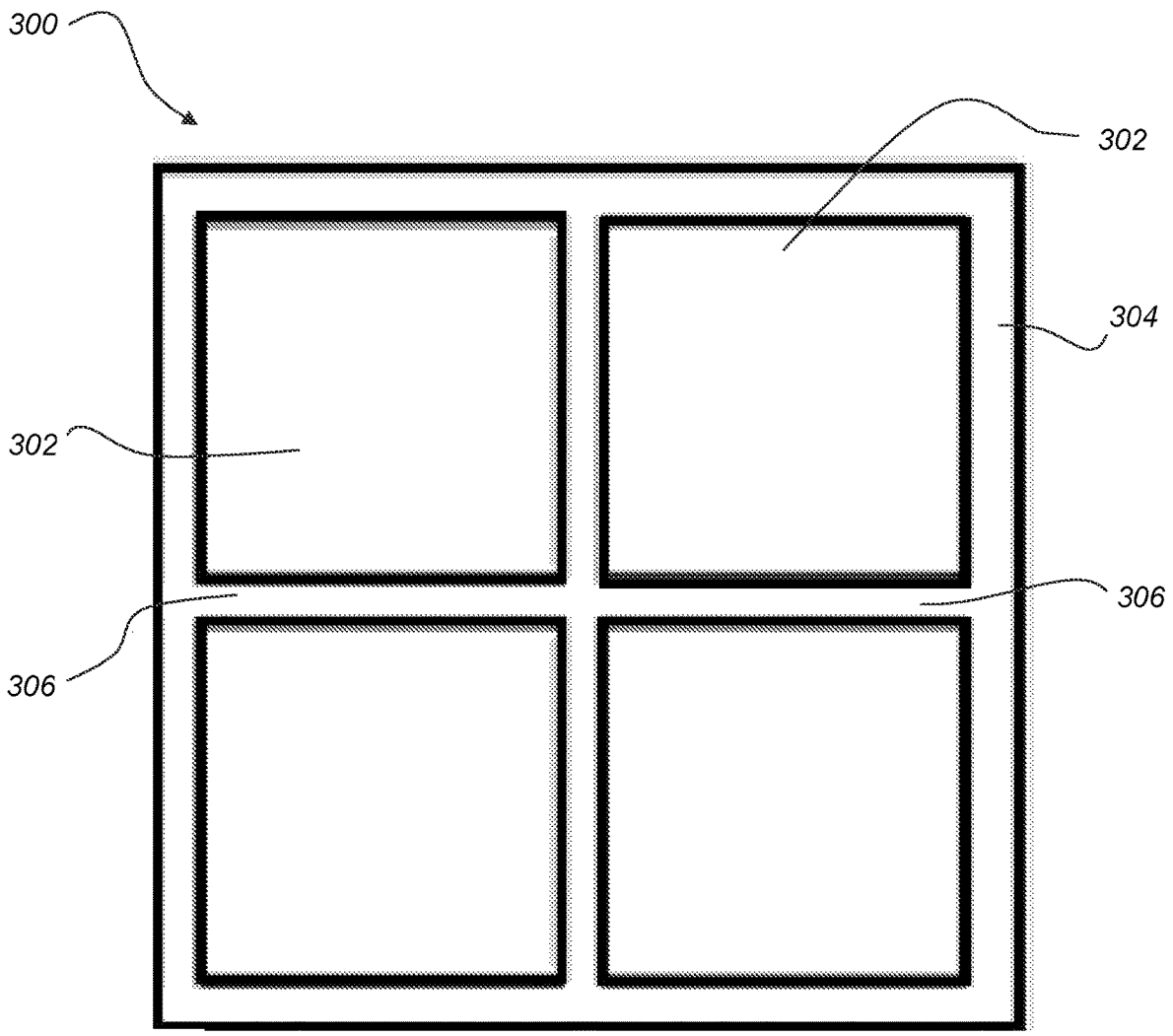
FIG. 5 is a top view of an embodiment of a reinforcing element.
Figure 6:
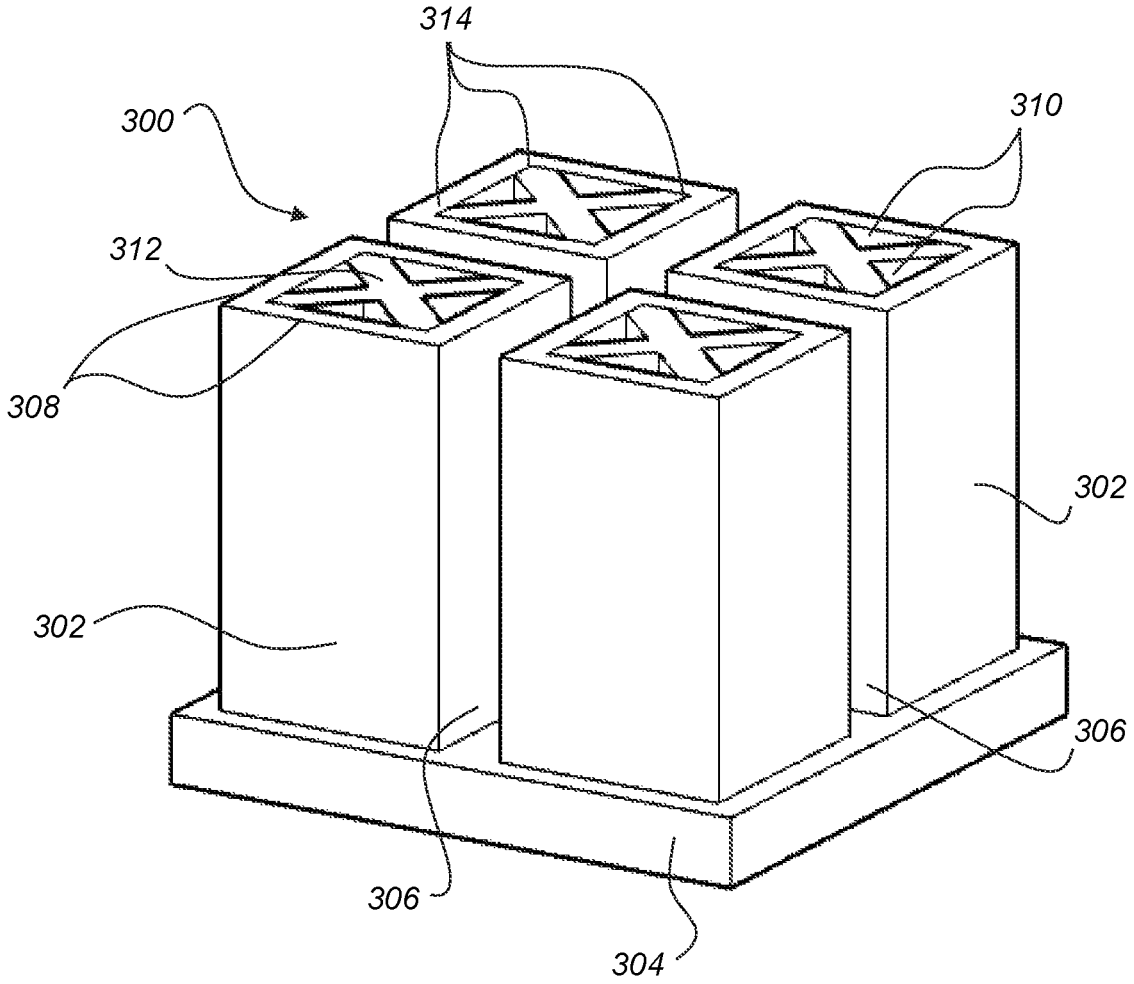
FIG. 6 is an isometric view of an embodiment of a reinforcing element.

FIGS. 5 and 6 demonstrate an embodiment of a reinforcing plug 300 (e.g., removable reinforcing element, removable stiffening feature) which may be employed with the cushioning element 102 of FIG. 2. Referring to FIGS. 2, 5, and 6 the reinforcing plug 300 may include protrusions 302 which may be complimentary to the voids 110 in the cushioning element 102 (e.g., may fit within the voids 110). The protrusions 302 may be formed over a base 304. The reinforcing plug 300 may also include gaps 306 between the protrusions 302 to allow the reinforcing plug 300 to span between the buckling walls 108. In some embodiments, the reinforcing plug 300 may comprise one protrusion 302. In other embodiments, the reinforcing plug 300 may comprise a plurality of protrusions 302, for example, two protrusions 302, three protrusions 302, four protrusions 302, or more.

In some embodiments, the protrusions 302 may protrude substantially the same distance from the base 304 as the thickness of the elastomeric cushioning element 102, such that the protrusions 302 extend completely through the elastomeric cushioning element 102 when the base 304 is in contact with the top surface 103 or bottom surface 105 of the elastomeric cushioning element 102. In other embodiments, the protrusions 302 may protrude from the base 304 a distance less than or greater than the thickness of the elastomeric cushioning element 102. For example, the protrusions 302 may extend a distance from the base 304, which is ½ the thickness of the elastomeric cushioning element 102, ⅓ the thickness of the cushioning element 102, or ¾ the thickness of the elastomeric cushioning element 102.

The elastomeric cushioning element 102 may have any selected dimensions based on the intended use. For example, if the cushion 100 is a mattress for a king size bed, the elastomeric cushioning element 102 may be approximately 76 inches (193 cm) by about 80 inches (203 cm), with a thickness of approximately 2 inches (5.08 cm). If the cushion 100 is a mattress for a queen size bed, the elastomeric cushioning element 102 may be approximately 60 inches (152 cm) by 80 inches (203 cm), with a thickness of approximately 2 inches (5.08 cm). If the cushion 100 is a mattress for an extra long twin size bed, the elastomeric cushioning element 102 may be approximately 38 inches (96.5 cm) by 80 inches (203 cm), with a thickness of approximately 2 inches (5.08 cm). In some embodiments, the elastomeric cushioning element 102 may have any other selected thickness, such as approximately 3 inches (7.62 cm), approximately 1 inch (2.54 cm), or approximately 4 inches (10.16 cm).

In some embodiments, the protrusions 302 may be solid (e.g., not hollow, full, or unitary). In other embodiments, the protrusions 302 may be hollow. In some embodiments, the hollow protrusions 302 may have an exterior wall 308 with a thickness greater than the thickness of the buckling walls 108 (e.g., in a manner similar to the embodiment shown and described with reference to FIG. 3A). In other embodiments, the exterior wall 308 thickness may be equal to or less than the thickness of the buckling walls 108. The exterior walls 308 may define a cavity 310 (e.g., void, hollow column) within the protrusion 302.

In some embodiments, the hollow protrusions 302 may include additional walls 312. The additional walls 312 may be oriented parallel, transverse, and/or perpendicular to one or more the exterior walls 308. The additional walls 312 may be positioned in a middle portion of the exterior walls 308 (e.g., may bisect the exterior walls 308) and extend perpendicularly from the exterior wall 308 to the opposite exterior wall 308 within the cavity 310 of the protrusion 302. In another embodiment, a plurality of additional walls 312 may be formed perpendicularly with equal spacing along the exterior walls 308. In other embodiments, the spacing between the additional walls 312 may not be equal. In some embodiments, a plurality of additional walls 312 may be positioned perpendicular to each other within the cavity 310 of the protrusions 302. In other embodiments, the plurality of additional walls 312 may be positioned parallel to each other within the cavity 310 of the protrusions 302.

In some embodiments, the additional walls 312 may be oriented at an angle from the exterior walls 302. For example, the additional walls 312 may be oriented such that they extend between corners 314 of the cavity 310 formed by the exterior walls 308. In some embodiments, the additional walls 312 may extend between each corner 314 of the cavity 310 intersecting in the middle forming an "X" shape. In other embodiments, a plurality of additional walls 312 may extend at a common angle relative to the exterior walls 308 with each additional wall 312 parallel to the other additional walls 312. For example, one of the additional walls 312 may extend between two of the corners 314 of the cavity 310, with other additional walls 312 running parallel to the first additional wall 312 offset on each side of the first additional wall 312 within the cavity 310.

In some embodiments, the reinforcing plug 300 may comprise protrusions 302 without a base 304. The protrusions 302 may be complimentary to the voids 110 in the cushioning element 102. The protrusions 302 may be independently inserted into the voids 110 allowing reinforcing plug 300 to be inserted over larger or smaller areas and in different geometric patterns depending on the requirements of each cushioning element 102. Each individual protrusion 302 may be attached to the cushioning element 102 using adhesives, thermal boding, or mechanical fasteners. For example, the protrusions 302 may be secured to the voids 110 or the top surface 103 (FIG. 1) and/or bottom surface 105 (FIG. 1) of the cushioning element 102 using glue (e.g., hot glue, water-based glue, etc.), hook and loop adhesives, heat fusing, staples, stitching, fabric covers, etc.

The reinforcing plug 300 may have a coating material (e.g., anti-tack material, anti-stick material) on surfaces of the exterior walls 302 and/or the additional walls 312. Coating materials may include a thin film or a powder as described in U.S. patent application Ser. No. 15/654,948, and U.S. patent application Ser. No. 15/062,674, both of which are assigned to the assignee of the present application, and previously incorporated by reference herein.

In some embodiments, the reinforcing plug 300 may be formed from a different elastomeric material than the elastomeric material used for the elastomeric cushioning element 102. The different elastomeric material may be formulated to have a higher elasticity (e.g., stiffness, young's modulus) than the elastomeric material used to form the other portions of the elastomeric cushioning element 102. In other embodiments, the reinforcing plug 300 may be formed from a non-elastomeric material (e.g., metal, wood, hard plastic).

Referring to FIGS. 2, 3A through 3C and 4. Some embodiments of the elastomeric cushioning element 102 may be formed in a single process. The reinforced corner 200 may be formed as part (e.g., an integral part) of the elastomeric cushioning element 102 in the single process. The reinforced corner 200 may be formed of the same elastomeric material as the elastomeric cushioning element 102. In another embodiment, the elastomeric cushioning element 102 may be formed in a first process. The reinforced corner 200 may be formed integrally with the elastomeric cushioning element 102 as part of a second process. The second process may include using a different elastomeric material from the first process. The elastomeric material used in the second process may have different elasticity than the elastomeric material used in the first process. In some embodiments, the elastomeric cushioning element 102 may be coated with an anti-tack material. Once the elastomeric cushioning element 102 is formed the cushion 100 may be assembled as shown in FIG. 1. The top layer 104 and bottom layer 106 may be attached to the elastomeric cushioning element 102. The cushion 100 may then be compressed for shipping using a roll packing machine as set forth above.

Referring to FIGS. 1, 2, 5, and 6. In some embodiments, the elastomeric cushioning element 102 may be formed separate from the reinforcing plug 300. The two separate processes may utilize the same elastomeric material or different materials. In some embodiments, at least one of the elastomeric cushioning element 102 and the reinforcing plug 300 may be coated with an anti-tack material. Once both the elastomeric cushioning element 102 and the reinforcing plug 300 are formed, the reinforcing plug 300 may be inserted into the elastomeric cushioning element 102 disposing the protrusions 302 of the reinforcing plug 300 within the voids 110 of the elastomeric cushioning element 102. The protrusions 302 may be substantially disposed within the voids 110 until the base 304 of the reinforcing plug 300 contacts the top surface 103 or bottom surface 105 of the elastomeric cushioning element 102.

In some embodiments, the reinforcing plug 300 may be inserted into the elastomeric cushioning element 102 before the top layer 104 and bottom layer 106 are attached to the elastomeric cushioning element 102. When inserted into the elastomeric cushioning element 102, the base 304 of the reinforcing plug 300 may act to stop the reinforcing plug 300 from passing completely through the elastomeric cushioning element 102. In some embodiments, the reinforcing plug 300 may be inserted into the elastomeric cushioning element 102 from the top surface 103 with the base 304 of the reinforcing plug 300 resting against the top surface 103 of the elastomeric cushioning element 102. In other embodiments, the reinforcing plug 300 may be inserted from the bottom surface 105 of the elastomeric cushioning element 102 with the base 304 of the reinforcing plug 300 resting against the bottom surface 105.

In some embodiments, a stabilizing material (e.g., scrim material) may be used to attach (e.g., adhere, glue, secure, etc.) the elastomeric cushioning element 102 to surrounding materials such as, for example, the reinforcing plug 300, the top layer 104, or the bottom layer 106. The stabilizing material is described in U.S. patent application Ser. No. 15/662,934, "Mattresses Including Spacer Fabric and Related Methods," filed Jul. 28, 2017, assigned to the assignee of the present application, the entire disclosure of which is hereby incorporated herein by this reference. The stabilizing material may be placed over the elastomeric cushioning element 102 with the previously inserted reinforcing plug 300. In some embodiments, the stabilizing material may be placed on the elastomeric cushioning element 102 opposite the base 304 of the reinforcing plug 300. The stabilizing material may attach the ends of the protrusions 302 opposite the base 304 to the elastomeric cushioning element 102 such that the reinforcing plug 300 may be secured by the base 304 on one end and the stabilizing material on the other. Once the elastomeric cushioning element 102 is assembled the cushion 100 may be assembled in the methods previously set forth. The cushion 100 may then be roll packed for shipping as set forth above.

In some embodiments, the reinforcing plug 300 may be shipped separate from the compressed cushion 100 (e.g., not inserted into the elastomeric cushioning element 102 before compression). The reinforcing plug 300 may be inserted into the elastomeric cushioning element 102 after the elastomeric cushioning element 102 expands to its expanded form.

The embodiments of the cushion described herein may improve the cushion's ability to retain its shape when a lateral force is applied to the cushion (e.g., to edge and/or corner portions of the cushion). In particular, embodiments of the disclosure may improve the ability of the cushion to retain its shape when an elastic cover is placed thereon. Such deformation of the cushion could cause fitment problems when placing the cushion in a securing base. Therefore, maintaining the shape of the cushion is a desirable feature when integrating the cushion with the frames and bases inherent with such cushions.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated by the inventor.

What is claimed:

1. A cushion comprising:

a plurality of intersecting walls, a common end of the plurality of intersecting walls defining a cushioning surface, the plurality of intersecting walls also defining a plurality of buckling columns that buckle around longitudinal axes oriented transverse to the cushioning surface when placed under a load applied transverse to the cushioning surface, the cushioning surface including an outer periphery with a plurality of corners, buckling columns comprising corner buckling columns disposed adjacent to each other of the plurality of corners and central buckling columns located laterally between the corner buckling columns, at least one buckling column of the corner buckling columns comprising a reinforced buckling column, with:

a characteristic of the at least one corner buckling column stiffening the at least one corner buckling column relative to the central buckling columns;

a stiffener within at least one corner buckling column stiffening the at least one corner buckling column relative to the central buckling columns; or the at least one buckling column comprising a solid column while the central buckling columns comprise hollow columns, and wherein the at least one corner buckling column is diagonally offset from a nearest corner of the at least one of the plurality of corners and at least a buckling column width from an edge of the nearest corner of the plurality of corners and stiffened relative to the central buckling columns and the nearest corner of the at least one of the plurality of corners.

2. The cushion of claim 1, wherein the characteristic is a density of a wall of the at least one corner buckling column, with the density of the wall of the at least one corner buckling column exceeding densities of walls of the central buckling columns.

3. The cushion of claim 1, wherein the characteristic is a stiffness of the at least one corner buckling column, with the stiffness of the at least one corner buckling column exceeding stiffnesses of the central buckling columns.

4. The cushion of claim 1, wherein the characteristic is a width of a wall of the at least one corner buckling column, with the width of the wall of the at least one corner buckling column exceeding widths of walls of the central buckling columns.

5. The cushion of claim 1, wherein the stiffener within the at least one corner buckling column comprises a plug formed separately from the cushion.

6. The cushion of claim 5, wherein the plug is adhesively secured within a void extending through a height of the at least one corner buckling column.

7. The cushion of claim 6, wherein at least a portion of the plug has a plug shape complementary to at least a portion of a shape of the void.

8. The cushion of claim 1, wherein the stiffener comprises at least one additional wall extending at least partially across a void through a height of the at least one corner buckling column.

9. The cushion of claim 8, wherein the stiffener comprises a plurality of additional walls extending least partially across the void.

10. The cushion of claim 9, wherein the plurality of additional walls intersect each other.

11. The cushion of claim 8, wherein the at least one additional wall extends completely across the void.

12. The cushion of claim 8, wherein the at least one additional wall interconnects with at least one wall defining the at least one corner buckling column.

13. The cushion of claim 1, wherein the stiffener comprises at least one protrusion extending from a base.

14. The cushion of claim 13, wherein the stiffener comprises a plurality of protrusions extending from the base.

15. The cushion of claim 14, wherein the plurality of protrusions intersect each other.

16. The cushion of claim 13, wherein the stiffener is formed separately from each wall defining the at least one corner buckling column and insertable into a void of the at least one corner buckling column.

17. The cushion of claim 1, wherein an entire height of the at least one corner buckling column is stiffened.

18. A cushion, comprising:

interconnected walls with ends that collectively define a cushioning surface that includes a periphery with a plurality of corners, the interconnected walls defining an array of buckling columns that buckle around longitudinal axes of the buckling columns when the buckling columns are placed under a load applied to the cushioning surface, corner buckling columns of the array of buckling columns disposed in each corner of the cushioning surface, and central buckling columns of the array of buckling columns disposed laterally between the corner buckling columns, wherein at least one of the corner buckling columns is diagonally offset from a nearest at least one corner and at least a buckling column width from an edge of the nearest corner of the plurality of corners and stiffened relative to the central buckling columns and the nearest corner of the at least one of the plurality of corners by:

a characteristic of the at least one corner buckling column stiffening the at least one corner buckling column relative to the central buckling columns;

a stiffener within at least one corner buckling column stiffening the at least one corner buckling column relative to the central buckling columns; or the at least one buckling column comprising a solid column while the central buckling columns comprise hollow columns.

19. The cushion of claim 18, wherein the characteristic of the at least one wall of the at least one corner buckling column comprises:

a stiffness of a material of the at least one wall relative to a stiffness of another material of walls of the central buckling columns;

an elasticity of the material of the at least one wall relative to an elasticity of the other material of the walls of the central buckling columns;

a thickness of the at least one wall relative to thicknesses of the walls of the central buckling columns.

20. The cushion of claim 18, wherein the at least one corner buckling column of the corner buckling columns includes a stiffener within a void extending through a height of the corner buckling column, the stiffener is manufactured separately from the cushioning element, and the stiffener is assembled with the cushion.

* * * * *